United States Patent [19]

Hirsch et al.

[11] Patent Number: 4,844,101

[45] Date of Patent: Jul. 4, 1989

[54] APPARATUS FOR EXPANDING COMMINUTED TOBACCO MATERIAL

[75] Inventors: Werner Hirsch; Erhard Rittrshaus, both of Hamburg; Arno Weiss, Norderstedt, all of Fed. Rep. of Germany

[73] Assignee: B.A.T. Cigarettenfabriken GmbH, Deutschland, Fed. Rep. of Germany

[21] Appl. No.: 171,055

[22] Filed: Mar. 21, 1988

[30] Foreign Application Priority Data

Mar. 31, 1987 [DE] Fed. Rep. of Germany ..... 3710677

[51] Int. Cl.[4] ..... A24B 3/18

[52] U.S. Cl. ..... 131/296; 131/291

[58] Field of Search ..... 131/291, 296

[56] References Cited

U.S. PATENT DOCUMENTS

| | | | |
|---|---|---|---|
| 4,418,706 | 12/1983 | Kim et al. | 131/296 |
| 4,513,758 | 4/1985 | Henzelin et al. | 131/291 |
| 4,523,598 | 6/1985 | Weiss et al. | 131/296 X |
| 4,625,736 | 12/1986 | Rothchild | 131/296 |
| 4,693,264 | 9/1987 | Hedge | 131/296 |
| 4,697,604 | 10/1987 | Brown et al. | 131/296 |
| 4,791,942 | 12/1988 | Rickett et al. | 131/296 X |

FOREIGN PATENT DOCUMENTS

| | | |
|---|---|---|
| 3147846 | 6/1983 | Fed. Rep. of Germany . |
| 3315274 | 11/1983 | Fed. Rep. of Germany . |
| 3234258 | 3/1984 | Fed. Rep. of Germany . |

OTHER PUBLICATIONS

Chemical Engineer's Handbook, John H. Perry et al., McGraw-Hill Book Company, Inc., 1963, pp. 7-32 through 7-33.

*Primary Examiner*—V. Millin
*Assistant Examiner*—Robert W. Bahr
*Attorney, Agent, or Firm*—Armstrong, Nikaido, Marmelstein, Kubovcik & Murray

[57] ABSTRACT

Comminuted tobacco material expanding apparatus which includes a cellular wheel feeder and an expansion chamber integrated in the cellular wheel feeder. A nozzle opening in a wall of the expansion chamber provides for the introduction of a mixture of air and steam for accelerating the tobacco material under a pressure drop to at least 50 m/s with a residence time of the tobacco material in the expansion chamber of less than about 1/10 s. At least one nozzle opening is located in an end wall of the expansion chamber near the bottom so that an adjustable steam/air mixture moves the tobacco material substantially at a right-angle out of the expansion chamber. The expansion chamber is connected to an acceleration tube with converging cross-section which is connected to a delay tube.

12 Claims, 4 Drawing Sheets

3BAR
10
12
14
16
16a
16b
16c
16d
18
20
22
23
24
25
26
27
28
30
32
34
36
38
40
42
44
46
48
50
54
56
58

APPARATUS FOR EXPANDING COMMINIUTED TOBACCO MATERIAL

BACKGROUND OF THE INVENTION

1. Field of the invention

The invention relates to an apparatus for expanding comminuted tobacco material.

The term "comminuted tobacco material" includes in particular cut rib and/or leaf material and reconstituted tobacco.

2. Description of the prior art

German Pat. No. 3,147,846 discloses an expansion method in which the tobacco material is subjected in a moist state within an extremely short period of time to a great temperature increase with pressure reaction. The resulting abrupt evaporation of the liquid contained in the tobacco particles, i.e. water, leads to an improvement of the filling power of the tobacco material by 30 to 100% without producing any appreciable destruction of the structure of the tobacco cells. In spite of the pronounced expansion and thus improvement in the filling power, the structure of the tobacco particles obtained immediately after the expansion is retained even in the further processing of the tobacco material.

A further apparatus for expanding comminuted tobacco material is shown in FIG. 5 in German Pat. No. 3,147,846 and comprises a rotary vane feeder for the supply of the tobacco material to an expansion chamber, a nozzle opening in a wall of the expansion chamber for introducing a hot gas for accelerating the tobacco material under pressure drop to at least 50 m/s with a residence time of the tobacco material in the expansion chamber of less than about 1/10 s and a delay tube following the expansion chamber.

The tobacco material entering the expansion system via the rotary, vane feeder impinges substantially perpendicularly on the free jet steam emerging from the nozzle opening, is accelerated by said free jet and at the same time expanded, and is carried away substantially horizontally to a drying means. When the tobacco material enters the expansion chamber, the steam condenses abruptly on the tobacco particles and within fractions of a second effects an increase of moisture and temperature up to the proximity of the condensation temperature corresponding to the pressure in the expansion chamber. Thereafter the tobacco particles are sucked into the reduced pressure in the free jet. The high heat and material exchange and the low pressure in the free jet lead to a "flash evaporation" of portions of the water disposed in the tobacco and thus effect the expansion of the tobacco particles.

For drying the resulting steam/tobacco-material mixture is blown directly into an air stream dryer.

In practice, with such an expansion apparatus various disadvantages have been encountered. In particular, the degree of expansion and thus finally the filling power of the tobacco material cannot be adjusted and thus varied.

Also, in the pneumatic transport of the tobacco material falling freely from the rotary vane feeder into the expansion chamber, not all of the tobacco particles come into intensive contact with the hot gas so that a comparatively inhomogenous expansion results, considered along the total volume of tobacco particles to be treated.

Furthermore, due to moisture tobacco particles can deposit in the rotary vane wheel and in the expansion chamber and this can lead to a clogging of the apparatus.

Finally, the known expansion apparatus has a high hot gas, generally steam, consumption so that methods are also being sought for reducing the costs involved.

SUMMARY OF THE INVENTION

The invention therefore has as its object the provision of an expansion apparatus of the type indicated in which the afore-mentioned disadvantages do not occur. In particular, an expansion apparatus is to be proposed with which the expansion degree and thus the filling power can be adjusted in wide ranges without any problems, in the extreme case between the expansion degrees 0 and 100%, this being done with simultaneous reduction of the consumption of steam and very homogeneous expansion for all tobacco particles. Furthermore, soiling of the expansion apparatus is to be avoided.

The invention therefore proposes in an apparatus for expanding comminuted tobacco material comprising a metering and supply means for supplying the tobacco material to an expansion chamber, a nozzle opening in a wall of the expansion chamber for introducing a hot gas consisting of air and steam for accelerating the tobacco material under a pressure drop to at least 50 m/s with a residence time of the tobacco material in the expansion chamber of less than about 1/10 s, and a delay tube with diverging cross-section following the expansion chamber, the improvement being in that the expansion chamber is integrated into the metering and supply means; the tobacco material is supplied approximately perpendicular to the nozzle opening; in an end wall of the expansion chamber there is at least one nozzle opening near the bottom of the expansion chamber so that an adjustable steam/air mixture is supplied; the expansion chamber is connected with an acceleration tube with converging cross-section, which is followed by the delay tube.

Advantageous embodiments are defined by the features of the subsidiary claims.

The advantages achieved with the invention are based on the following mode of operation: The expansion chamber is integrated into the metering and supply means, thus an expansion chamber is created to which an exactly defined amount of tobacco material is supplied.

The metering and supply means may be a rotary vane feeder, in particular a blow-through rotary vane feeder, a metering screw, etc.

This expansion chamber may be sealed very tightly so that the entire gas supplied to said expansion chamber is available for the expansion and the pneumatic transport of the tobacco material.

In an end wall of the metering and supply means there is at least one, preferably three, nozzle openings which are so arranged that the tobacco particles conveyed into the expansion chamber must necessarily pass across the nozzle openings. From said nozzle openings an adjustable steam/air mixture enters the expansion chamber substantially perpendicularly to the metering and supply means of the tobacco material at high speed and breaks the tobacco agglomerations conveyed into the expansion chamber down into individual fibres, i.e. the principle employed is comparable to a pneumatic blade.

By means of the resolving of the tobacco agglomerations (tobacco lumps) into individual fibres, each individual fibre is given an intensive contact with the steam- /air mixture. In addition, substantially narrower flow cross-sections can be chosen, i.e. for given flow rates substantially less hot gas is required.

When arranging the nozzle openings it should be ensured that the Coanda effect is avoided.

The free jet cleans the traversed parts of the metering and supply means in a manner comparable to a steam jet cleaner. Furthermore, due to a kind of wiping movement of the tobacco material over the bottom of the expansion chamber, the latter is kept free from tobacco deposits.

The ratio steam/air in this mixture may be adjusted in constructionally simple manner, for example via corresponding valves, so that a desired expansion degree and thus a desired filling power of the tobacco material can be set.

Since for static reasons not all of the tobacco particles come into intensive contact with the free jet emerging from the nozzle opening, an acceleration tube with converging cross-section is provided following the expansion chamber. In this tube all of the tobacco particles undergo an acceleration with heat and material exchange and a simultaneous continuous pressure drop, this in turn leading to a flash evaporation of portions of the water present in the tobacco.

The acceleration tube is followed, possibly with interposition of a tube of constant cross-section, by a delay tube via an abrupt increase in the cross-section.

In contrast to the continuous cross-section increase, the abrupt increase in the cross-section prevents pressure recovery (pressure increase) after the acceleration tube.

A pressure increase after the acceleration tube would have the outcome that the expansion result achieved would be partially cancelled again.

Because of the thorough mixing of the steam and tobacco particles and the use of the principle of the pneumatic blade, the steam consumption can be substantially reduced compared with the known expansion apparatuses.

In such an expansion apparatus operating with a steam/air mixture, the expansion degree can be continuously adjusted from 0 to a maximum value. The expansion degree depends substantially on which temperature and energy gradient is reached between the tobacco particles warmed by condensation on the one hand and the evaporation temperature corresponding to the low pressure in the free jet emerging from the nozzle opening on the other hand. When using a saturated steam/air mixture, the tobacco particles are heated by condensation at the most to the dew-point temperature of the mixture used. This dew point temperature, corresponding substantially to the temperature of the tobacco particles, depends on the concentration of the steam/air mixture and the pressure in the expansion chamber.

The expansion by flash evaporation starts, when the tobacco temperature exceeds the evaporation temperature in the free jet, and increases with increasing temperature difference.

The simplest way of making a steam/air mixture is the admixture of compressed air into the high-pressure steam conduit upstream of the expansion chamber. Since, however, the generation of compressed air is relatively expensive, this solution will probably be practicable only for experimental or pilot apparatuses.

A more economical solution is the use of a fan for admixing the air. For this purpose the pressure loss on injection into the expansion chamber must be reduced. This is done by opening additional nozzle bores in the end wall of the expansion chamber.

To achieve the maximum expansion, for which high jet velocities and pure steam atmosphere are necessary, these additional nozzles are closed.

A solution is obtained without additional energy expenditure when using a steam jet pump. However, here as well the pressure loss must be lowered by variable cross-sections upon injection into the expansion chamber.

The steam/air ratio in the hot gas supplied to the expansion chamber can be varied within seconds so that regulation of the expansion degree and thus the filling power is possible in that the filling power is measured, for example, downstream from the dryer following the expansion apparatus; on deviation from a given desired value, the ratio steam/air in the hot gas is adjusted accordingly.

BRIEF DESCRIPTION OF THE DRAWINGS

The invention will be described in more detail hereinafter with the aid of examples of embodiment with reference to the accompanying schematic drawings, wherein.

DESCRIPTION OF THE PREFERRED EMBODIMENTS

Figures 1, 2:
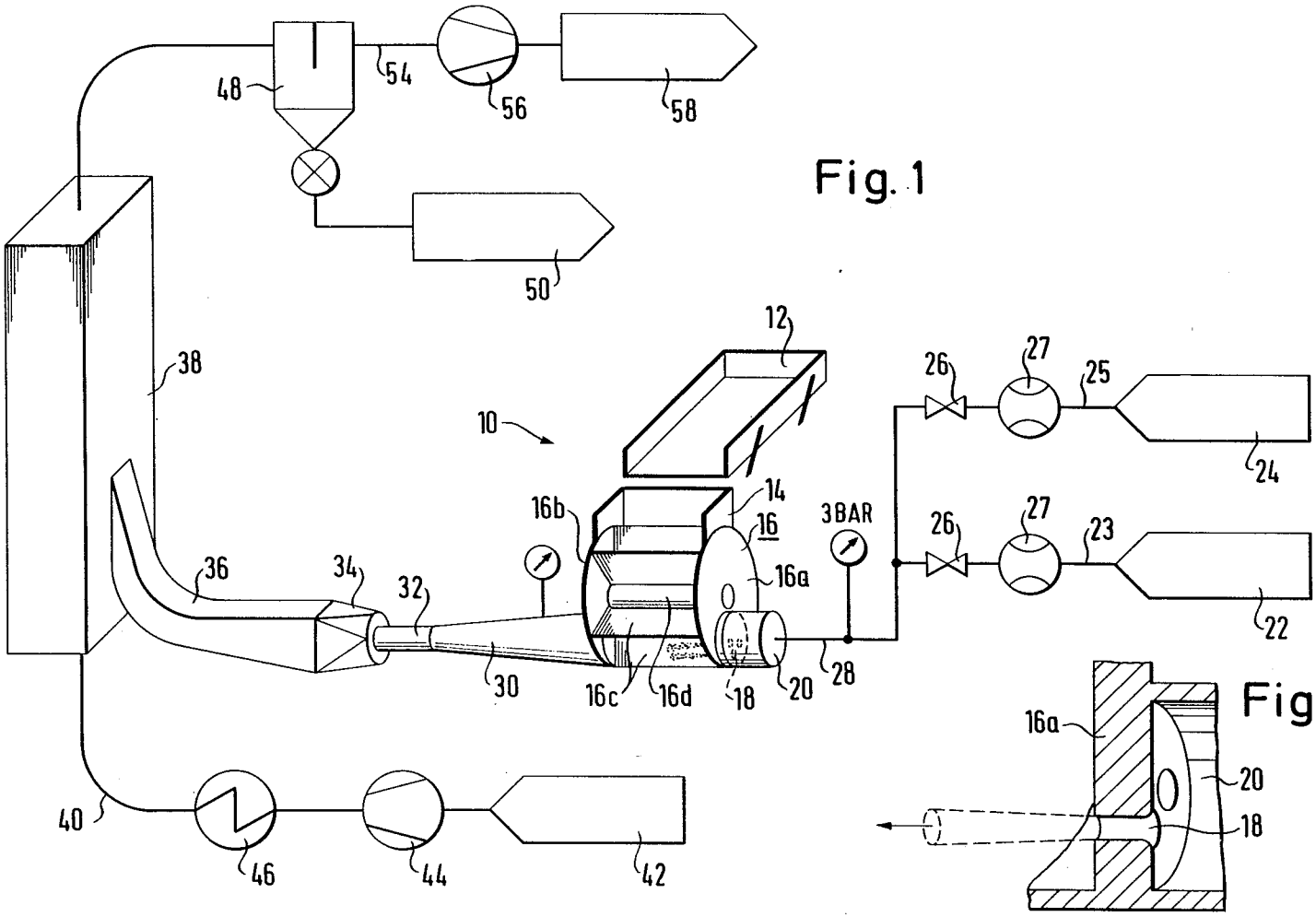
FIG. 1 shows the basic structure of an expansion apparatus with blow-through rotary vane feeder and following an air stream dryer with tangential separator.
FIG. 2 shows to a larger scale the free jet emerging from a nozzle opening.

In the expansion apparatus shown in FIG. 1 and denoted generally by reference numeral 10, the comminuted, in particular cut, tobacco material (not shown) as a rule cut rib and/or leaf material, or also reconstituted tobacco, drops from a vibrating conveyor trough 12 through a filling opening 14 downwardly into a rotary vane or cellular wheel feeder 16 which comprises two opposing parallel disc-shaped end walls **16*a*, 16*b* between which the rotatable shaft 16*d* of the rotary vane wheel is disposed. On said shaft a plurality of vanes 16*c* is mounted so that between two adjacent vanes 16*c*** the falling comminuted tobacco material is collected and entrained on rotation of the vanes about the axis of the rotary vane wheel.

With the exception of the region in the vicinity of the filling opening 14, the rotary vane or cellular wheel is surrounded by a cylindrical chamber which is not shown in detail and on the inner wall of which the outer ends of the vanes **16*c*** are continuous, thus avoiding gas losses.

In this cellular wheel sluice or rotary vane feeder 16, a "movable" expansion chamber is integrated and is formed in each case by the two lowermost vanes **16*c*** in conjunction with the portion of the chamber wall extending between said two vanes.

In the portion of the right end wall **16*a* according to the illustration of FIG. 1 associated with said expansion chamber in the example of embodiment illustrated, there are three nozzle openings 18; in this embodiment the nozzle openings 18** have a circular cross-section and can be formed, for example, by cylindrical bores.

Alternatively, it would also be possible to provide slit-shaped nozzle openings. The essential point is only that the nozzle openings 18 are located in the vicinity of the bottom of the expansion chamber and the Coanda effect is avoided.

At the right end wall 16*a* a distributing chamber 20 follows which communica via the nozzle openings 18 with the expansion chamber. A water vapour/air mixture at a pressure of about 3 bar is supplied to the distributing chamber 20 as indicated in FIG. 1.

To generate this water vapour/air mixture, compressed air is supplied from a compressed air source 22 and saturated steam is supplied from a corresponding source 24 via conduits 23, 25 with flow meters 27 and regulating valves 26; compressed air and steam are mixed in the high-pressure steam conduit 28 upstream from the distributing chamber 20.

At the outlet of the expansion chamber in the left end wall 16*b* of the rotary vane feeder 16, an acceleration tube 30 follows with a cross-section converging in the conveying direction which merges into a further tube 32 of constant cross-section. The tube 32 is followed by a step-like enlargement of the circular cross-section which then merges into a delay tube 34 with rectangular, in particular square, cross-section.

Said tube 34 is followed by a curve tube 35, through which the tobacco material is supplied to an air-stream dryer 38.

Via a conduit 40 the dryer 38 receives air from a source 42 which is accelerated via a fan 44 and heated via a heating means 46.

The mixture tobacco material/air leaving the dryer 38 is separated in a tangential separator 48 into tobacco material on the one hand, which is supplied to the corresponding outlet 50, and air on the other hand, which is supplied along a conduit by means of a fan 56 to the outlet 58.

In this expansion apparatus 10 when the comminuted tobacco material is entrained by the vanes 16*c* of the rotary vane wheel downwardly onto the bottom of the cylindrical chamber surrounding the rotary vane wheel, it is there entrained by the steam/air mixture flowing with a pressure of 3 bar via the distributing chamber 20 and the nozzle openings 18 into the expansion chamber and accelerating the tobacco material under pressure drop to at least 50 m/s. By a sort of "wiping effect" the tobacco material is wiped in layers across the bottom and thereby transported out of the expansion chamber into the tube 30.

Expediently, the nozzle openings 18 are adapted to the movement direction of the rotary vane wheel so that the first tobacco particles introduced by a vane 16*c* into the expansion chamber are immediately subjected to the steam/air mixture and therefore the residence time of the tobacco material in the expansion chamber is less than about 1/10 s.

The temperature of the steam/air mixture, the concentration of which can be varied by appropriate adjustment of the regulating valves 26, should lie between 50° and 500° C.

In the acceleration tube 30 the tobacco material partially expanded in the free jets is pneumatically transported, expanded once again and supplied to the step-like transition between the tube 32 and the tube 34. The step and the subsequent transition from the circular cross-section to the square cross-section ensures a very careful treatment of the sensitive, now expanded tobacco particles which are also guided gently in the curved tube 36 and dried by means of hot air supplied in the dryer 38; the tobacco material/air mixture thus formed is separated in the tangential separator 48 into the two components which are supplied to the respective outlets, that is the air outlet 58 on the one hand and the tobacco material outlet 50 on the other hand.

FIG. 2 shows again to an enlarged scale the emergence of a free jet into the expansion chamber.

The "steam injection" into the chamber taking place with high velocity leads to an extremely high heat and material transfer in conjunction with a pronounced conveying effect in the direction of the arrow for the individual tobacco particles.

As already indicated above, the generation of compressed air is relatively expensive so that this solution is suitable only for experimental or pilot apparatuses.

Figure 3:
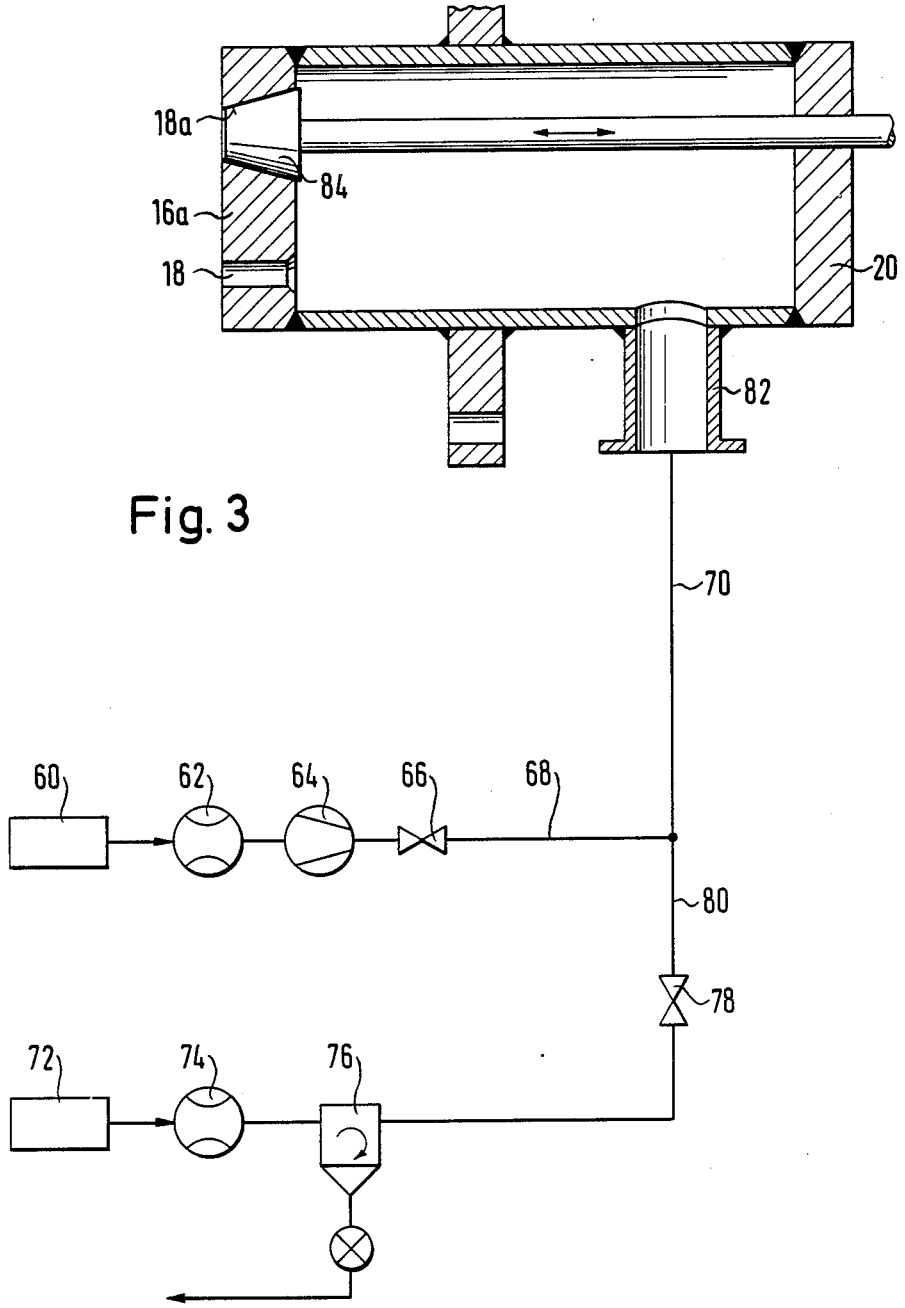
FIG. 3 is a cross-section through a distributing chamber preceding the expansion chamber with one embodiment of a flow drive.

A more economical solution is shown in FIG. 3, namely the use of a fan for introducing the air. In this embodiment the air is supplied from a source 60 via a flow meter 62, a fan 64 and a regulating valve 66 along a conduit 68 and is mixed in the conduit 70 with the steam which is supplied from a source 72 via a flow meter 74, a steam dryer 76 and a regulating valve 78 to a conduit 80. The conduit 70 with the steam/air mixture is connected to a tube piece 82 of the distributing chamber 20, The left end wall 16*a* of the distributing chamber 20, seen in the illustration of FIG. 3 and corresponding to the right end wall 16*a* of the rotary vane feeder 16, comprises two types of openings towards the expansion chamber, namely lower nozzle openings 18 of constant flow cress-section and upper openings 18*a* having a circular flow cross-section diminishing towards the expansion chamber.

Whereas the nozzle openings 18 are always open, the nozzle openings 18*a* can be closed to a greater or lesser degree as required; for this purpose a piston 84 extends in the longitudinal direction of the distributing chamber 20; the left end of said piston in the illustration of FIG. 3 projects into the nozzle openings 18*a* and therefore closed the flow cross-section thereof to a greater or lesser degree.

The pressure loss occurring upon introduction of the steam/air mixture from the distributing chamber 20 into the expansion chamber can be lowered in that the additional nozzle openings 18*a* are opened by shifting the piston 84 to the right. For maximum expansion, for which high jet velocities and a pure steam atmosphere are necessary, the additional nozzle openings 18*a* are closed, i.e. the steam now flows with extremely high velocity through the nozzle openings 18 into the expansion chamber.

Of course, if required, a plurality of additional nozzle openings 18*a* can be provided; each nozzle opening 18*a* must then have a piston 84 associated therewith.

Figure 4:
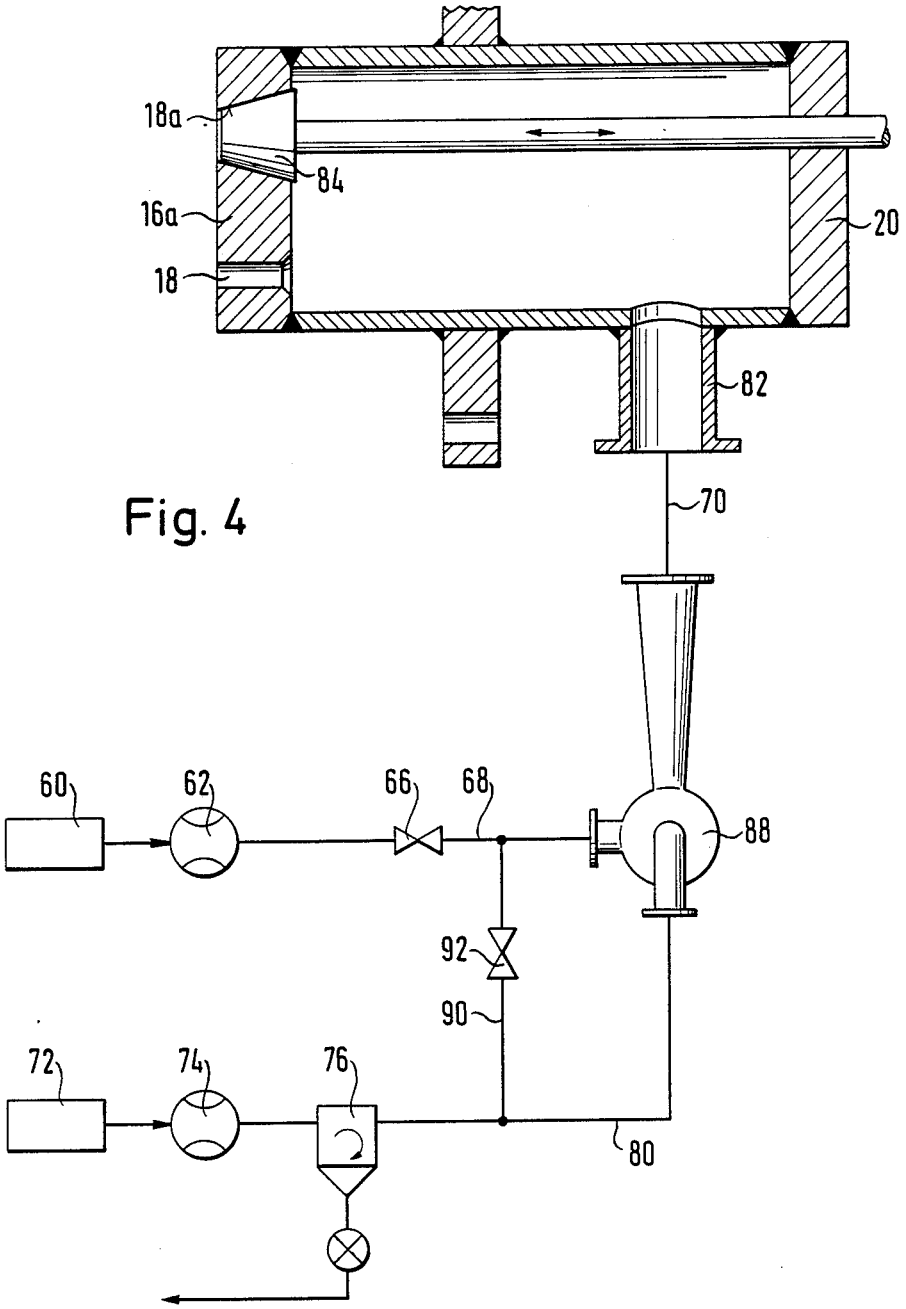
FIG. 4 is a further cross-section through the distributing chamber with another embodiment of the flow drive.

FIG. 4 shows another embodiment without additional energy costs in which as flow drive a stream jet pump or steam injector 88 is used. Said steam jet pump 88 is connected on the one hand via the conduit 70 to the connecting pieces 82 of the distributing chamber 20, which has the construction shown in FIG. 3, and on the other hand via the conduit 68, the valve 66 and the flow meter 62 to the air source 60. In addition the steam jet pump 88 is connected to the conduit 80 with the steam dryer 76, the flow meter 74 and the steam source 72.

The two conduits 68, 80 are connected via a further conduit 90 to a regulating valve 92.

In this embodiment for the generation of the steam-/air mixture, the pressure loss upon injection from the distributing chamber 20 into the expansion chamber must also be lowered by the variable cross-section of the nozzle opening 18*a*.

To improve the quality of the end product "cigarette", a uniformly expanded tobacco material is desired. Regulation to constant expansion can be achieved by influencing the expansion and use of suitable sensors for the filling-power measurement, for example by means of continuous rollers as known from German Offenlegungsschrift No. 3,234,258.

The construction of a corresponding control circuit is made suitable and possible by the very high response velocity of the expansion apparatus, since any change of the expansion achieved takes place almost without delay; the time constant of a few seconds occurring is due only to the transport paths of the tobacco material from the expansion chamber to the filling-power measurement.

Figure 5:
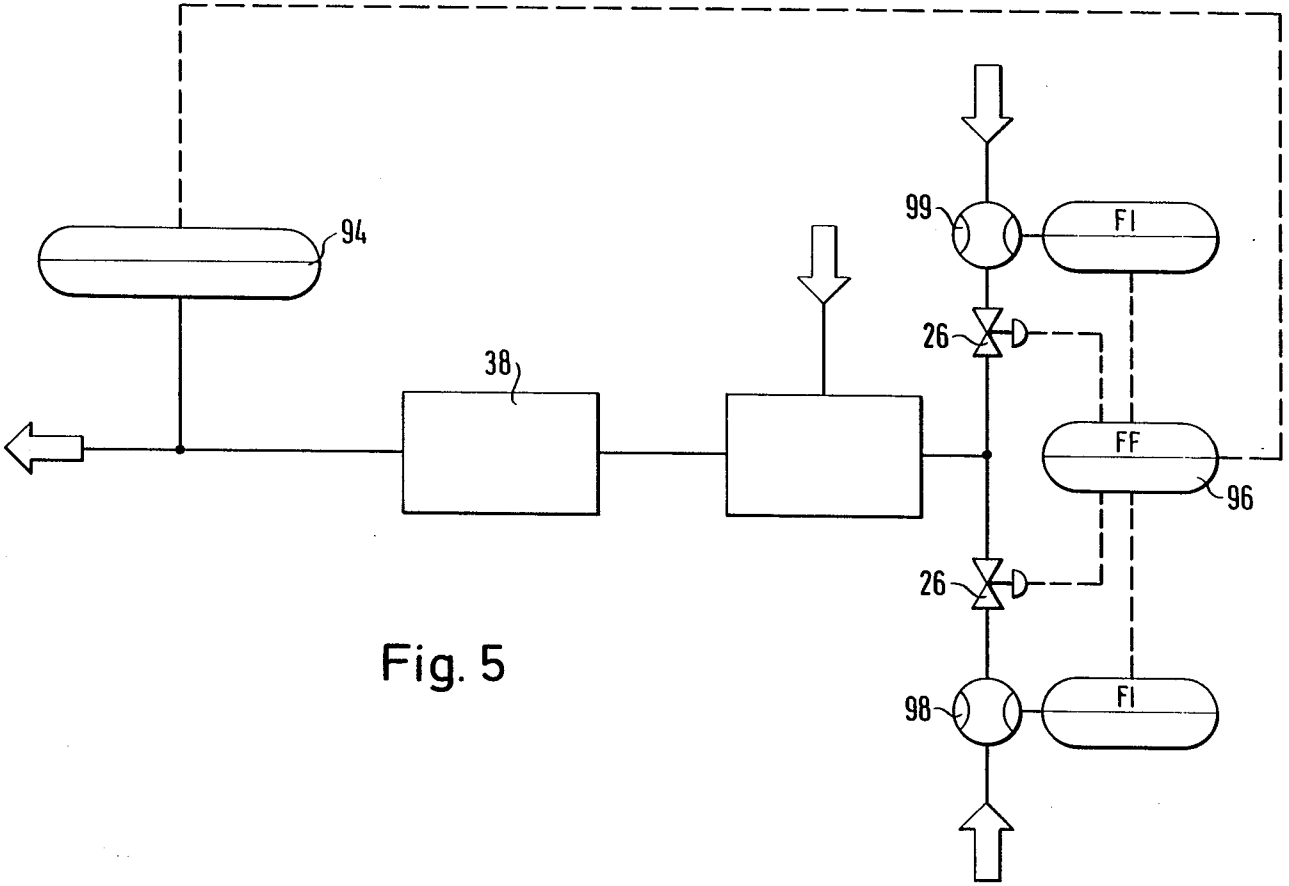
FIG. 5 shows in the form of a block circuit diagram the control of the expansion degree and thus the filling power.

FIG. 5 shows a basic illustration of such an expansion control which does not have any influence at all on other process parameters, for example the setting of the dryer.

The filling power of the expanded cut tobacco is detected by means of a suitable sensor, as disclosed, for example, in German Offenlegungsschrift No. 3,234,258. This actual value from the sensor 94 is supplied to a control means 96 which also receives actual values from two flow meters 98, 99, namely a flow meter 98 for the amount of steam and a flow meter 99 for the amount of air.

From these three actual values the control means, for example in accordance with a given algorithm, forms adjusting signals for the two actuating members, namely the two regulating valves 26 for the air and steam in the embodiment of FIG. 1.

The regulating valves in the other embodiments according to FIGS. 3 and 4 can also be actuated in corresponding manner.

This makes it possible to set and regulate the expansion in the expansion apparatus, indicated only diagramatically and having the construction shown in FIG. 1, but taking account of the actual value of the filling power.

As an alternative to the embodiments illustrated, the expanded tobacco material/hot gas mixture need not be supplied directly to an air stream dryer, but can also be separated in suitable separators, and the expanded tobacco material can be supplied, for example, to a drum/belt or fluid-bed dryer.

Finally, another special feature compared with other expansion methods is that irrespective of the set expansion degree only a very small loss of tobacco constituents is detected. This is due to the low temperatures during the expansion and the extremely short treatment time.

We claim:

1. An apparatus for expanding comminuted tobacco material which includes a feeder for supplying tobacco material to an expansion chamber and a nozzle for introducing a hot gas consisting of steam and air for the acceleration of the tobacco material in the expansion chamber under a pressure drop to at least 50 m/s with a residence time of the tobacco material in the expansion chamber of less than about 1/10 s and a delay tube having a diverging cross-section connected for receiving said tobacco material downstream of said expansion chamber, wherein the improvement comprises:

a cellular wheel tobacco material feeder and an expansion chamber integrated within the cellular wheel feeder, said expansion chamber having two end walls, a distributing chamber provided on an exterior surface of one of said end walls, at least one nozzle opening through said one end wall and providing fluid communication between said distributing chamber and a lower portion of said expansion chamber, said cellular wheel feeder supplying said tobacco material approximately perpendicular to the nozzle opening internally of said expansion chamber, a source of saturated steam and a source of air connected by fluid conduits to said distributing chamber, at least one adjustable regulating valve in said fluid conduits for adjusting a mixture of steam and air supplied to said expansion chamber and an acceleration tube having a converging cross-section connected between the other end wall of said expansion chamber and said delay tube.

2. An apparatus according to claim 1, wherein said cellular wheel feeder is a blow-through rotary vane feeder.

3. An apparatus according to claim 1, wherein at least three nozzle openings are provided through said one wall of said expansion chamber.

4. An apparatus according to claim 3, wherein the nozzle openings comprise bores formed to provide jet streams of said mixture of steam and air which are approximately parallel to each other and approximately perpendicular to an internal face of said one wall of said expansion chamber.

5. An apparatus according to claim 1, wherein a slit-shaped nozzle opening is provided through said one wall of said expansion chamber.

6. An apparatus according to claim 1, wherein the acceleration tube is connected to said delay tube by a tube of constant cross-section.

7. An apparatus according to claim 6, wherein a step-like transition is provided between the tube of constant cross-section and the delay tube.

8. An apparatus according to claim 7, wherein the delay tube changes from circular cross-section to square cross-section.

9. An apparatus according to claim 1, wherein said one end wall of the expansion chamber includes a plurality of nozzle openings of constant cross-section and nozzle openings of conically diminishing cross-section which are closeable by a displaceable piston.

10. An apparatus according to claim 1, further including a fan connected in said conduit connecting said source of air to the distributing chamber and serving to drive said mixture of steam and air.

11. An apparatus according to claim 1, further including a steam jet pump connected in said conduit connecting said source of saturated steam to the distributing chamber and serving to drive said mixture of steam and air.

12. An apparatus according to claim 1, further including a sensor for detecting the product filling power of tobacco material which has been expanded in said expansion chamber, flow meters in said conduits for steam and air and a control circuit including control means which receives output signals of the sensor and the flow meters and emits signals to adjust the regulating valves and control the mixture of steam and air in accordance with a predetermined algorithm.

* * * * *

UNITED STATES PATENT AND TRADEMARK OFFICE

CERTIFICATE OF CORRECTION

PATENT NO. : 4,844,101

DATED : July 4, 1989

INVENTOR(S) : HIRSCH et al

It is certified that error appears in the above-identified patent and that said Letters Patent is hereby corrected as shown below:

On the cover page, Item [75], "Erhard Rittrshaus" should read --Erhard Rittershaus--.

Signed and Sealed this

Eighth Day of May, 1990

*Attest:*

HARRY F. MANBECK, JR.

*Attesting Officer*

*Commissioner of Patents and Trademarks*